US005535872A

United States Patent [19]

Smith et al.

[11] Patent Number: 5,535,872

[45] Date of Patent: Jul. 16, 1996

[54] COIN/TOKEN SEPARATOR

[75] Inventors: Peter R. Smith, West Essendon; Darren E. Beauchamp, Glossodia, both of Australia

[73] Assignee: Microsystem Controls Pty. Ltd., Australia

[21] Appl. No.: 396,332

[22] Filed: Feb. 28, 1995

Related U.S. Application Data

[63] Continuation of Ser. No. 7,604, Jan. 22, 1993, abandoned, which is a continuation-in-part of Ser. No. 961,893, filed as PCT/AU91/00295, July 4, 1991. , Pat. No. 5,476,168.

[30] Foreign Application Priority Data

Jul. 5, 1990 [AU] Australia ..... PK1057

[51] Int. Cl.[6] ..... G07D 3/14

[52] U.S. Cl. ..... 194/317; 194/346

[58] Field of Search ..... 194/346, 317, 194/318, 319; 193/31 A, DIG. 1; 453/3

[56] References Cited

U.S. PATENT DOCUMENTS

| | | | |
|---|---|---|---|
| 3,870,137 | 8/1975 | Fougere | 194/100 A |
| 4,105,105 | 8/1978 | Braum | 194/319 |
| 4,410,077 | 10/1983 | Okolischan | 194/1 K |
| 4,570,779 | 2/1986 | Abe | 194/344 X |
| 4,582,189 | 4/1986 | Schmitt | 194/346 X |
| 4,838,406 | 6/1989 | Levasseur | 194/346 |
| 4,884,672 | 12/1989 | Parker | 194/346 X |

FOREIGN PATENT DOCUMENTS 1321241 6/1973 United Kingdom .

*Primary Examiner*—F. J. Bartuska
*Attorney, Agent, or Firm*—Reed Smith Shaw & McClay

[57] ABSTRACT

The invention relates to a coin/token separator comprising:

(a) an inlet through which coins/tokens (C) pass;

(b) at least two outlets (29, 30) to receive separated coin/tokens (C); and (c) a separator interposed between (a) and (b) including:

(i) an arm (21) pivotable on a floating pivot (28) and movable between a first position in which the coin/token is directed towards one of the outlets (28) and a second position in which the coin/token (C) passes to another of the outlets (30), the arm (21) being normally biased into the first position; and (ii) a solenoid (18) actuated by a signal to move the arm (21) from the first position to the second position.

25 Claims, 2 Drawing Sheets

COIN/TOKEN SEPARATOR

CROSS-REFERENCES TO RELATED APPLICATIONS

This is a continuation of application Ser. No. 08/007,604, filed on Jan. 22, 1993, now abandoned, which is a continuation-in-part of national stage application Ser. No. 07/961,893 filed Jan. 4, 1993, now U.S. Pat. No. 5,476,168, which is based on PCT application No. PCT/AU91/00295 filed Jul. 4, 1991 which claims priority of Australian application Serial No. PK1057 filed Jul. 5, 1990.

FIELD OF THE INVENTION

This invention relates to an apparatus and a method of separating coins and tokens.

BACKGROUND OF THE INVENTION

Generally speaking, high speed coin/token operated gaming machines, ie. poker machines or slot machines have been limited to single coin/token acceptance.

In each of the above applications, especially in gaming machines, the quicker the coin/token validation system can operate the greater the turnover possible from such machines. It has recently been proposed in relation to gaming machines that input hoppers may be attached to the machine to allow an operator to play the game more quickly.

In Application No. PCT/AU91/00295 a coin validation system is disclosed which pulses an incoming coin and analyses a back EMF curve or de-energization curve to obtain a signature of the incoming coin/token. This is compared to reference information. It is possible to analyse many (7 or more) coins/second and provide a signal to an accept/reject mechanism which forms part of the coin path. If an invalid coin is identified the accept/reject mechanism does not move from constituting part of the coin path. However, if a valid coin is identified the accept/reject mechanism withdraws from the coin path and that coin is passed to another passageway.

It will be evident that if the accept/reject mechanism used in association with the coin validation system cannot react as quickly as the validation system, there will be no overall increase in the speed with which coins/tokens can be processed.

Further, current coin validation systems aim to identify valid coins from invalid coins. In gaming machines there is a further need to process the stream of valid coins. For example to direct a part of the stream to different locations.

With current designs, coins are introduced into the machine through a coin validator (comparator) which, with the exception of the validator the subject of Application No. PCT/AU91/00295, have a limited ability of only being able to recognise one particular coin denomination. These coins are directed via a diverter gate to either the coin hopper or the cash box. If the hopper is full, a signal is given to the diverter to direct coins to the cash box. When the coins in the hopper fall to a preset level a signal is then given to the diverter to change position and direct all coins to the coin hopper.

As the complexity of the games played upon gaming machines has increased so has the maximum bet value. It is not uncommon to have a $10 bet on a 20¢ machine which would require the insertion of 50 coins, a tedious task. Player acceptance and cash input could both be increased if the machine were capable of accepting 20¢ coins plus high denominations eg $1 and $2 coins and provide the appropriate number of 20¢ credits.

The speed of operation of the separator mechanism is therefore becoming critical if it is to separate a higher volume of coin or token throughput and/or separate multi-denominational coin token streams. Current separating mechanisms are not capable of reliably sorting a stream of multi-denominational coins into two paths at 7 coins/sec.

DESCRIPTION OF THE INVENTION

Accordingly in a first embodiment of the invention a coin/token separator is provided comprising:

(a) an inlet through which coins/tokens pass;

(b) at least two outlets to receive separated coins/tokens; and (c) separating means interposed between (a) and (b) including:

(i) an arm pivotable on a floating pivot and movable between a first position in which a coin/token is directed towards one of the outlets and a second position in which a coin/token passes to another of the outlets, the arm being normally biassed into the first position; and (ii) a solenoid and a magnet actuated by a signal to move the arm from the first position to the second position.

In a second embodiment of the invention, the arm at the floating pivot is separated from the magnet on the first position. As such upon the solenoid being actuated the arm at the floating pivot is attracted to the magnet. Upon contact a high magnetic flux is generated to apply more force to move the other end of the arm into the second position. This allows extremely rapid movement of the arm.

In a third embodiment of the invention, the arm at the floating pivot contacts the magnet in the first position. Accordingly, upon actuation of the solenoid an immediate maximum flux is generated between the arm and the magnet, to further improve the rapid movement of the arm into the second position. A gate stop is included to urge the arm at the floating pivot into contact with the magnet. Preferably the gate stop is intermediate the ends of the arm, which combines with the biassing means to urge the arm into the first position.

In another preferred embodiment of the invention the separating means further comprises a timer to maintain the solenoid activated for a predetermined period of time after which the solenoid is deactivated.

In another preferred embodiment of the invention the inlet and one of the outlets are vertically aligned to permit a coin/token to fall from the inlet and, if uninterrupted, through the outlet.

In another preferred embodiment of the invention the inlet and another of the outlets are vertically offset by a minimum amount to permit a coin/token to free fall from the inlet, be deflected by the separating means and pass through the other outlet.

In another preferred embodiment of the invention a partition is located between adjacent outlets and define passageways for the coins/tokens. This enhances the channelling of coins/tokens through the outlets.

In another preferred embodiment of the invention the coin/token separator further comprises a chute. The chute preferably has an opening between the inlet and the partitions through which a portion of the arm (eg. angle plate) is movable between the first position in which it extends into the coin/token passageway and a retracted position in which the arm does not extend into the coin/token passageway. In this way the arm and solenoid are substantially isolated from the coin/token path. As coins/tokens may be dirty or wet, it is unlikely that dirt or moisture may interfere with the action of the solenoid upon the arm or upon the movement of the arm.

In a fourth embodiment of the invention the separator may be incorporated downstream of a coin/token validator which coin validator includes:

(a) a reference path for coin/token;

(b) detection means to detect the presence of at least a part of the coin/token on the reference path;

(c) defining means operable in response to the coin/token being detected as in (b) above, to derive a definition of said coin/token; and (d) comparator means to compare the definition to stored information relating to coins/tokens.

In a fifth embodiment of the invention a coin/token validator is provided including:

(a) a reference path for a coin/token;

(b) detection means to detect the presence of at least a part of the coin/token on the reference path;

(c) defining means operable in response to the coin/token being detected as in (b) above, to derive a definition of said coin/token;

(d) comparator means to compare the definition to stored information relating to coins/tokens;

(e) separator means operable in response to the comparison as in (d) above to allow the coin/token to move to one of a plurality of destinations; the separator means comprising:

(A) an inlet through which coins/tokens pass;

(B) at least two outlets to receive separated coins/tokens; and (C) separating means interposed between (A) and (B) including:

(i) an arm pivotable on a floating pivot and movable between a first position in which a coin/token is directed towards one of the outlets and a second position in which a coin/token passes to another of the outlets, the arm being normally biassed into the first position in which the arm at the floating pivot contacts a magnet; and (ii) a solenoid and the magnet actuated by a signal to move the arm from the first position to the second position.

In a sixth embodiment of the invention, a method is provided of separating coins/tokens according to predetermined information and directing them to a plurality of destination comprising the steps of:

(i) detecting the presence of at least a part of a coin/token falling in a free fall reference path; and (ii) moving separating mean into the reference path to direct the coin/token towards one of a plurality of outlets in response to the predetermined information.

In a preferred form of the above embodiment of the invention the separating means includes an arm pivotable on a floating pivot and movable between a first position in which a coin/token is directed towards one of the outlets and a second position in which a coin passes to another of the outlets, the arm being normally biassed into the first position; and a solenoid actuated by a signal to move the arm from the first position to the second position.

DESCRIPTION OF THE DRAWINGS

The invention is now illustrated with reference to the accompanying drawings in which.

DESCRIPTION OF THE PRESENTLY PREFERRED EMBODIMENT

Figure 1:
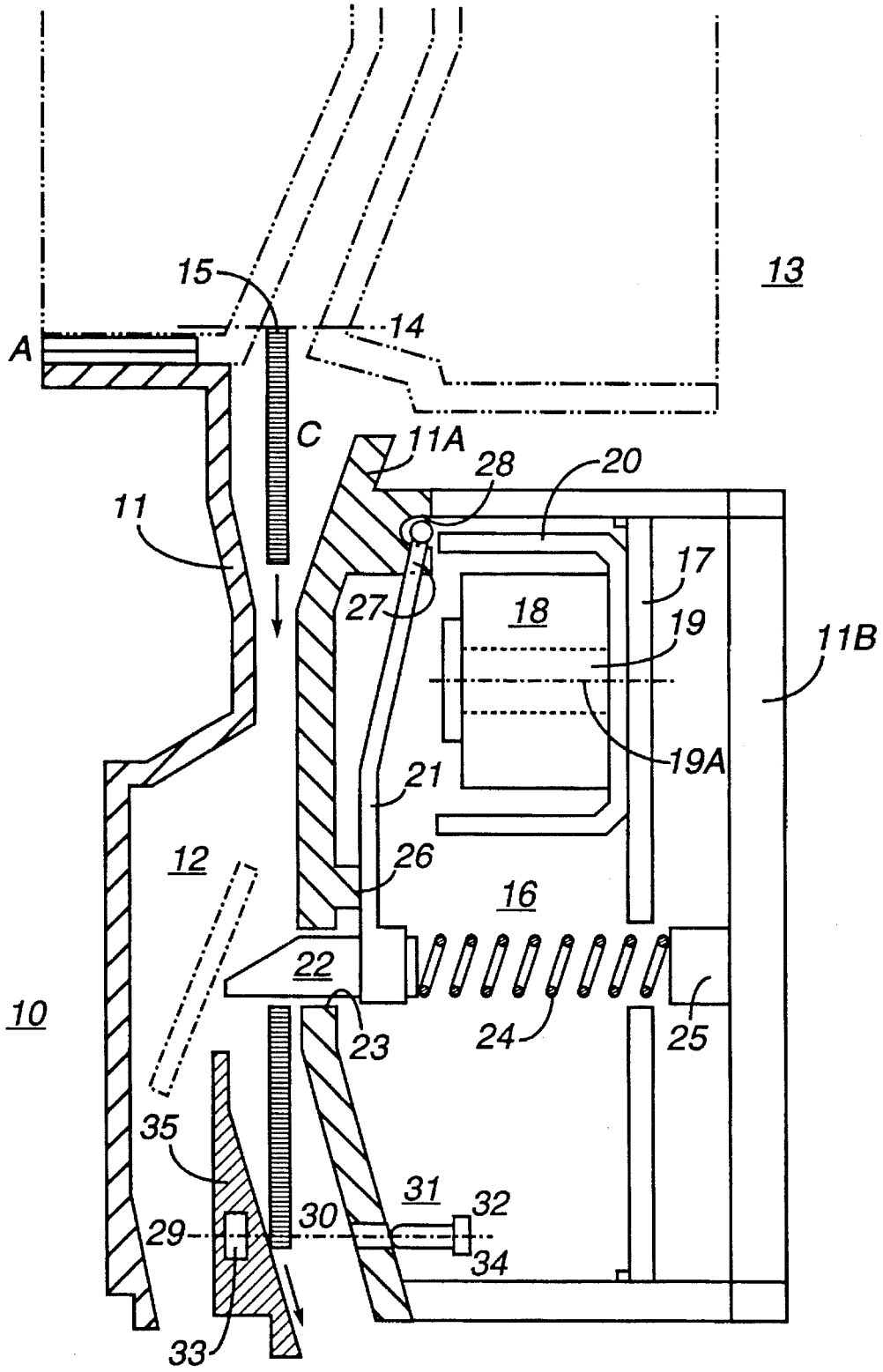
FIG. 1 is a cross-sectional view of the separator according to one form of the invention.

As shown in FIG. 1, the separator 10 comprises a multi part housing 11, 11A and 11B. Housing 11 and 11A combine to define a coin/token chute through which a coin/token may pass.

A coin/token validator 13 is shown in ghost outline to which the separator 10 is slidingly engaged at A. The coin/token validator 13 has a coin/token exit sensor 14 which senses the trailing edge 15 of an exiting coin/token. This information is used in conjunction with other coin/token validator information to initiate the separating function of separator 10. The preferred coin/token validator is disclosed in patent application no. PCT/AU91/00295.

Whilst the drawings show separator 10 in combination with a coin/token validator its use is not so limited. It will be clear to any person skilled in the art that the separator 10 can function in response to any predetermined information.

The separating mechanism 16 is mounted within housing 11B via a printed circuit board 17. This mechanism 16 includes an electromagnet 18 comprised of a solenoid coil 19, a magnet 20 and solenoid core 19A.

As shown in FIG. 1 the separator 10 is in a deflecting position. Arm 21 has a projection 22 extending through opening 23 in housing 11A. The projection 23 has an angle plate surface which assists to achieve the desired deflection. No other openings are provided in housing 11A which restricts the potential for dirt and moisture entering and interfering with the separating mechanism 16. Housings 11A and 11B combine to provide a sealed unit for electronics.

Projection 22 is urged through opening 23 by a spring 24 mounted upon a base 25 of housing 11B.

A stop gate 26 provides a pivot point which by the combined operation of spring 24 on projection 22 biasses the other end 27 into contact with the magnet 20. End 27 is not attached to magnet 20 and forms a floating pivot 28 about which the arm 21 and projection 22 may rotate when solenoid 18 is energised.

The chute 12 is split into at least two exit passageways 29 and 30 by at least partition 35. Partition 35 does not extend above opening 23 so that any separation of coins/tokens by the projection 22 is not interfered with.

In operation, a coin/token C falls from coin/token validator 13. The trailing edge 15 of coin C is sensed and a control signal is generated to either maintain exit passageway 30 blocked by projection 22 or to energise solenoid coil 19 to withdraw projection 22. In the latter case a timing mechanism (not shown) can control the period of energisation of the coin and hence the time that projection 22 with withdrawn.

In operation, the generated control signal provides predetermined information relative to the coin being examined. The arrangement is such that in response to the predetermined information, further including steps of:

A. either (a) energizing a solenoid to withdraw separating means from the reference path at a location above the plurality of outlets to allow the coin/token to continue to free fall towards a predetermined one of the plurality of outlets, (b) maintaining said solenoid energized, and thus said separating means withdrawn from said reference path, for a predetermined period of time; and (c) de-energizing said solenoid at the expiry of said predetermined period of time to allow said separating means to move into said reference path;

B. or (a) maintaining said separating means in said reference path at a location above the plurality of outlets to direct said coin/token to free fall towards another one of said plurality of outlets, or (b) moving said separating means into said reference path to direct said coin/token to free fall towards another of the plurality of outlets.

By sensing the trailing edge 15 of coin/token C and allowing the coin to free fall the timer can be set for a standard period of energisation. No matter the size or mass of coin/token C the same time interval will be appropriate to allow the coin/token to fall a predetermined height.

The following is a more detailed explanation of the separating mechanism 16. The energisation of solenoid coil 19, magnet 20 and solenoid core 19A will cause north and south magnet poles of a magnetic field to be generated. Arm 21 is attracted towards solenoid core 19A thereby withdrawing projection 22 from the chute 12 against the bias of spring 24. The incoming coin will free fall uninterrupted through chute 12 and in particular through exit passageway 30 and from the separator 10.

Upon de-energisation, the solenoid coil 19 no longer attracts arm 21. Spring 24 operates to urge projection 22 into the chute 12 and deflect an incoming coin from its free fall path into exit passageway 29.

A sensing system 31 is located at the lower part of exit passageway 30. System 31 comprises a light emitting diode (D) 32, a lens 33 and receiver 34. The LED 32 and receiver 34 are mounted side by side in the body formed by housings 11A and 11B opposite the lens 33 which is located in partition 35.

The sensor system 31 operates such that light from LED 32 travels horizontally across exit passageway 30 and enters the base of lens 33. The light is reflected internally at one point on the internal surface of lens 33. It is then reflected upon an opposed point of the internal surface of lens 33 and in turn back across the exit passageway 30 into receiver 34.

Any coin/token breaking either or both light beams will cause a signal to be generated. This sensor system 31 is located close to the exit from the separator 10 below separating mechanism 16 thereby ensuring that a coin/token which generates a signal has in fact left the separator 10.

The sensing system 31 can be used to generated signals to facilitate measurement of the quantity of coins/tokens going through exit passageway 30.

Accordingly if the separator 10 was incorporated into a gaming machine, exit passageway 29 feeds the cash box whilst exit passageway 30 feeds a hopper. If the hopper is full a signal is given to the separator 10 to all direct coins/tokens to the cash box. When the coins in the hopper fall to a preset level a signal may be given to the separator 10 to direct particular coins/tokens to the hopper.

Likewise by attaching this type of separator downstream of a coin validator which can distinguish multi denominations, it is possible to have the separator direct certain value coins/tokens to a preselected exit passage.

Figure 2:
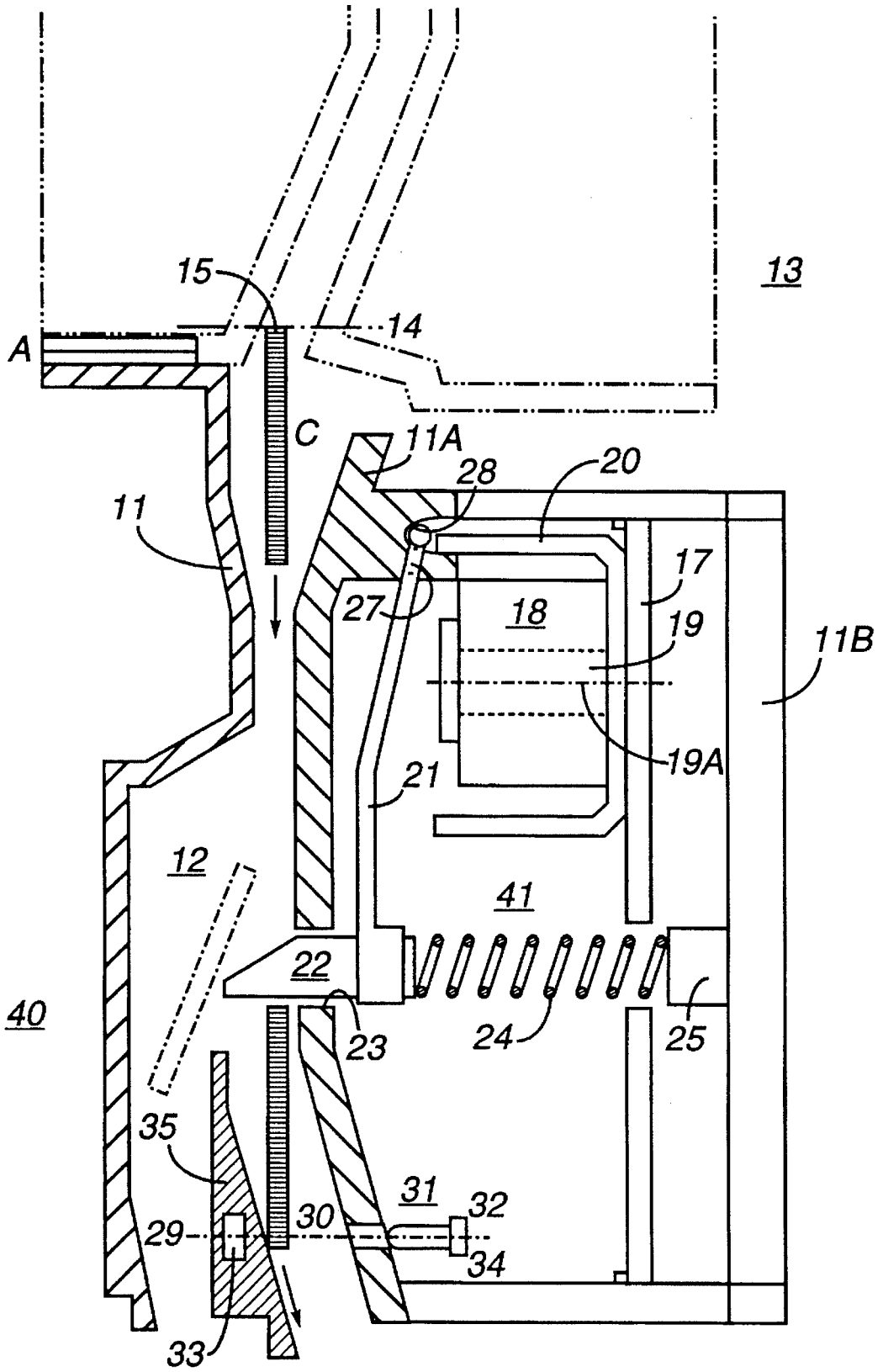
FIG. 2 is a cross-sectional view of a separator with an alternative diverter mechanism.

An alternate separator 40 incorporating an alternative separating mechanism 41 is shown in FIG. 2 and like components are given like numerical designations to those of FIG. 1. Unless otherwise specified these components have the same function/description to that given in relation to FIG. 1.

The basic difference between the separators 10, 41 of FIGS. 1 and 2 is the separating mechanisms 16, 41. In FIG. 2, the separator 40 comprises the same basic componentry, however, magnet 20 is not in contact with the end 27 of arm 25 when projection 22 projects into chute 12. However it is only marginally spaced eg. 0.5 ml. The end 27 of arm 21 is a floating pivot 28. When solenoid coil 19 is energised, a magnetic flux through magnet 20 which attracts end 27 of arm 25. Once end 27 is in contact with magnet 20, arm 25 is then rapidly pivoted towards solenoid coil 19 thereby withdrawing projection 22 against spring 24 and out of chute 12.

We claim:

1. A coin/token separator comprising:

(a) an inlet through which coin/tokens pass;

(b) at least two outlets to receive separated coins/tokens; and (c) separating means interposed between (a) and (b) including;

(i) an arm pivotable on a floating pivot and movable between a first position in which a coin/token is directed towards one of the outlets and a second position in which a coin/token passes to another of the outlets, the arm being normally biassed into the first position in which the arm at the floating pivot is separated from a magnet;

(ii) a solenoid and the magnet actuated by a signal to move the arm from the first position to the second position; and (iii) upon activation of the solenoid, the arm of the floating pivot contacts the magnet prior to the arm moving into the second position.

2. A coin/token separator according to claim 1 further comprising a gate stop to limit pivotal movement of the arm by the biassing means.

3. A coin/token separator according to claim 2 wherein the gate stop contacts the arm intermediate the ends of the arm.

4. A coin/token separator according to claim 1 wherein an angle plate is connected to the arm to direct the coin/token.

5. A coin/token separator according to claim 1 wherein the inlet and one of the outlets are vertically aligned to permit a coin/token to fall from the inlet and through another of the outlets.

6. A coin/token separator according to claim 5, wherein the inlet and another of the outlets are marginally vertically offset to permit a coin/token to fall from the inlet, be deflected by the separating means and pass through the other outlet.

7. A coin/token separator according to claim 4, wherein the angle plate in the first position is contacted by a rim or face of a coin/token falling from the inlet.

8. A coin/token separator according to claim 1 wherein a partition is located between adjacent outlets but below the first position, and define passageways for the coins/tokens.

9. A coin/token separator according to claim 1 further comprising a chute defining a coin/token passageway having:

(i) an opening at an upper end thereof defining the inlet through which coins/tokens pass;

(ii) at least two openings at a lower end thereof defining the outlets to receive separated coins/tokens; and (iii) at least one partition defining separate passageways to each of the outlets.

10. A coin/token separator according to claim 9 wherein the chute has an opening between the inlet and the partitions, and in the first position the angle plate extends into the coin/token passageway and in a retracted position the angle plate does not extend into the coin/token passageway.

11. A coin/token separator according to claim 9, wherein the chute between the inlet and the separating means comprises at least two converging walls.

12. A coin/token separator according to claim 9, wherein the chute has a minimum width above the separating means smaller than the minimum width of the separate passageway of each of the outlets.

13. A coin/token separator according to claim 9 wherein the inlet and one of the outlets are vertically aligned to permit a coin/token to fall down the coin/token passageway from the inlet and through the outlet.

14. A coin/token separator according to claim 13 wherein the inlet and another of the outlets are marginally vertically offset to permit a coin/token to fall from the inlet, be deflected in the coin/token passageway by the separating means and pass through the other outlet.

15. A coin and/or token validator separator including:

(a) a reference path for a coin/token;

(b) detection means to detect the presence of at least a part of the coin/token on the reference path;

(c) defining means operable in response to the coin/token being detected as in (b) above, to derive a definition of said coin/token; and (d) separator means to separate coin/token received in at least one of the plurality of destinations, the separator means comprising:

(A) an inlet through which coins/token pass;

(B) at least two outlets to receive separated coins/tokens; and (C) separating means interposed between (A) and (B) including:

(i) an arm pivotable on a floating pivot and movable between a first position in which a coin/token is directed inwards one of the outlets and a second position in which a coin/token passes to another of the outlets, the arm being normally biassed into the first position;

(ii) a solenoid actuated by a signal to move the arm from the first position to the second position; and (iii) the arm in the first position is in contact with a magnet at the floating pivot.

16. A coin/token validator including:

(a) a reference path for a coin/token;

(b) detection means to detect the presence of at least a part of the coin/token on the reference path;

(c) defining means operable in response to the coin/token being detected as in (b) above, to derive a definition of said coin/token;

(d) comparator means to compare the definition to stored information relating to coins/tokens;

(e) separator means operable in response to a signal to allow the coin/token to move to one of a plurality of destinations; the separator means comprising:

(A) an inlet through which coins/tokens pass;

(B) at least two outlets to receive separated coins/tokens; and (C) separating means interposed between (A) and (B) including:

(i) an arm pivotable on a floating pivot and movable between a first position in which a coin/token is directed towards one of the outlets and a second position in which a coin/token passes to another of the outlets, the arm being normally biassed into the first position in which the arm at the floating pivot contacts a magnet; and (ii) a solenoid and the magnet actuated by a signal to move the arm from the first position to the second position.

17. A coin/token validator according to claim 16 wherein the inlet and one of the outlets are vertically aligned to permit a coin/token to fall from the inlet and through the outlet.

18. A coin/token validator according to claim 16 wherein the inlet and another of the outlets are marginally vertically offset to permit a coin/token to fall from the inlet, be deflected by the separating means and pass through the other outlet.

19. A coin/token validator according to claim 16 wherein the arm in the first position is contacted by rim or face of the coin/token.

20. A coin token validator according to claim 16 wherein a partition is located between adjacent outlets but below the first portion and define passageways for the coins/tokens.

21. A coin/token validator according to claim 16 further comprising a chute defining a coin/token passageway having:

(i) an opening at an upper end thereof defining the inlet through which coins/tokens pass;

(ii) at least two opening at a lower end thereof defining the outlets to receive separated coins/tokens; and (iii) at least one partition defining separate passageways to each of the outlets.

22. A coin/token validator according to claim 21 wherein the chute has an opening between the inlet and the partitions and in the first position the angle plate extends into the coin/token passageway and in a retracted position the angle plate does not extend into the coin/token passageway.

23. A coin/token separator according to claim 22, wherein the chute between the inlet and the separating means comprises at least two converging walls.

24. A coin/token validator according to claim 21 wherein the inlet and one of the outlets are vertically aligned to permit a coin/token to fall down the coin/token passageway from the inlet and through the outlet.

25. A coin/token validator according to claim 23 wherein the inlet and another of the outlets are marginally vertically offset to permit a coin/token to fall from the inlet, be deflected in the coin/token passageway by the separating means and pass through the other outlet.

* * * * *